US007825769B2

(12) United States Patent
Nomura et al.

(10) Patent No.: US 7,825,769 B2
(45) Date of Patent: Nov. 2, 2010

(54) TERMINAL STRUCTURE OF CHIPLIKE ELECTRIC COMPONENT

(75) Inventors: Yutaka Nomura, Toyama (JP); Katsumi Takeuchi, Toyama (JP)

(73) Assignee: Hokuriku Electric Co., Ltd., Toyama-Shi (JP)

( * ) Notice: Subject to any disclaimer, the term of this patent is extended or adjusted under 35 U.S.C. 154(b) by 329 days.

(21) Appl. No.: 12/088,268

(22) PCT Filed: Sep. 27, 2006

(86) PCT No.: PCT/JP2006/319185

§ 371 (c)(1),
(2), (4) Date: Mar. 27, 2008

(87) PCT Pub. No.: WO2007/037279

PCT Pub. Date: Apr. 5, 2007

(65) Prior Publication Data

US 2009/0231086 A1 Sep. 17, 2009

(30) Foreign Application Priority Data

Sep. 27, 2005 (JP) ..... 2005-280616
Jul. 31, 2006 (JP) ..... 2006-207547

(51) Int. Cl.
*H01C 1/012* (2006.01)

(52) U.S. Cl. ..... 338/309; 338/313; 338/327

(58) Field of Classification Search ..... 338/307–309, 338/313, 327, 332
See application file for complete search history.

(56) References Cited

U.S. PATENT DOCUMENTS 5,680,092 A * 10/1997 Yamada et al. ..... 338/309

(Continued)

FOREIGN PATENT DOCUMENTS

JP 07-169601 7/1995

(Continued)

*Primary Examiner*—Kyung Lee
(74) *Attorney, Agent, or Firm*—Rankin, Hill & Clark LLP

(57) ABSTRACT

A terminal structure of a chip-like electric component capable of blocking entry of electromigration-causing factors through an insulating resin layer in the vicinity of the peak of a raised portion of an electrical element forming layer is obtained. A metal-glaze-based front electrode 103 containing silver is provided on a surface of an insulating ceramic substrate 101. A resistor layer 107 electrically connected to the front electrode 103 is provided on the substrate surface. A glass layer 109*a* is provided to completely cover a surface of the resistor layer 107 as well as a surface of an end portion of the resistor layer 107 and also to partially cover the front electrode 103. An insulating resin layer 109*b* is provided to cover a surface of the glass layer 109*a* as well as a surface of at least an end portion of the glass layer 109*a* and to partially cover the front electrode 103. A conductive layer 117 made of a resin-based conductive paint is provided to extend over the surface of the front electrode 103 and an portion of the insulating resin layer 109*b* in the vicinity of the peak of raised end portion of the insulating resin layer 109*b*. The resin-based conductive paint is made by kneading particulate conductive silver powder and scale-like conductive silver powder into an epoxy-based insulating resin paint.

4 Claims, 2 Drawing Sheets

U.S. PATENT DOCUMENTS

| | | | | |
|---|---|---|---|---|
| 6,023,217 | A * | 2/2000 | Yamada et al. | 338/309 |
| 6,150,920 | A * | 11/2000 | Hashimoto et al. | 338/309 |
| 6,242,999 | B1 * | 6/2001 | Nakayama et al. | 338/309 |
| 6,492,896 | B2 | 12/2002 | Yoneda | |
| 6,724,295 | B2 * | 4/2004 | Tsukada | 338/309 |
| 6,982,624 | B2 | 1/2006 | Saito et al. | |
| 2004/0262712 | A1 | 12/2004 | Doi | |

FOREIGN PATENT DOCUMENTS

| | | |
|---|---|---|
| JP | 07-302510 | 11/1995 |
| JP | 08-186001 | 7/1996 |
| JP | 08-236302 | 9/1996 |
| JP | 2001-126901 | 5/2001 |
| JP | 2002-064003 | 2/2002 |
| JP | 2002-184602 | 6/2002 |
| JP | 2002-237402 | 8/2002 |
| JP | 2004-362950 | 12/2004 |

* cited by examiner

PRIOR ART

TERMINAL STRUCTURE OF CHIPLIKE ELECTRIC COMPONENT

TECHNICAL FIELD

The present invention relates to a terminal structure of a chip-like electric component.

BACKGROUND ART

Chip-like electric components typically include a chip resistor, a chip inductor, a chip capacitor, and a chip-like composite electronic component formed by a combination of a plurality of types of electrical elements. Among the chip-like electric components are a chip-like electric component referred to as a multiple chip component of a multiple structure with a plurality of electrodes provided respectively on two opposed sides of an insulating substrate, in addition to a chip-like electric component having an electrode for soldering at each end of an insulating substrate.

Among terminal structures adopted in the conventional chip-like electric components, there is a terminal structure that uses a metal-glaze-based electrode containing silver. A configuration example of the terminal structure of this type will be described with reference to a terminal structure disclosed in Japanese Patent Application Publication No. 2002-237402 [Patent Document 1]. FIG. 3 is a vertical cross-sectional view showing a terminal structure of a publicly known chip-like resistor actually manufactured and marketed, based on Japanese Patent Application Publication No. 2002-237402. In the terminal structure of a chip-like resistor of this type, a metal-glaze-based front electrode 3 containing silver is provided on a front surface at an end portion of an insulating ceramic substrate 1. Further, a metal-glaze-based back electrode 5 containing silver is provided on a back surface at an end portion of the substrate. The front electrode 3 and the back electrode 5 of the paired structures are arranged to face each other with the insulating ceramic substrate 1 interposed therebetween. These metal-glaze-based front electrode 3 and back electrode 5 both containing silver are respectively formed by printing a metal glaze paste on the insulating ceramic substrate and then firing the printed metal glaze paste, for example. The metal glaze paste is formed by kneading Ag conductive powder or Ag—Pd conductive powder into a glass paste. A resistor layer 7 is formed on the front surface of the insulating ceramic substrate 1 as an electrical element forming layer electrically connected to the front electrode 3. Further, an electrically-insulating protective layer 9 made of an insulating material is formed to cover the overall resistor layer 7. The insulating protective layer 9 covers a portion of the front electrode 3, or partially covers the front electrode 3. The insulating protective layer 9 of this publicly known chip resistor is a two-layer structure formed of a glass layer 9*a* and an insulating resin layer 9*b*. In an actual product, the glass layer 9*a* is provided, covering a surface of the resistor layer 7 up to the top height or a peak of a raised portion 7*a* of the resistor layer 7 on an end portion of the front electrode 3, as illustrated. The insulating resin layer 9*b* is provided to cover a surface of the glass layer 9*a* as well as a surface of an end portion of the glass layer 9*a*, and also to partially cover the front electrode 3. At an end surface of the insulating ceramic substrate 1 where the front electrode 3 and the back electrode 5 are provided, a side electrode 11 is provided to electrically connect the front electrode 3 and the back electrode 5. The side electrode 11 is formed, using an Ag-resin-based conductive paint made by mixing silver into xylene-phenol resin or epoxy-phenol resin. Then, a conductive thin film layer 13 formed of two-plated layers is provided to cover an entire surface of the side electrode 11, also to cover an exposed portion of the front electrode 3, and to cover an entire back surface of the back electrode 5. The conductive thin film layer 13 is formed of a lower conductive thin film layer 13*a* and an external conductive thin film layer 13*b*. The lower conductive thin film layer 13*a* in this example is formed of a nickel-plated layer, while the external conductive thin film layer 13*b* is formed of a solder-plated layer.

No particular problem arises in the chip-like electric component having such a terminal structure as long as the chip-like electric component is used in an ordinary environment. However, it is known that when an electric apparatus including a circuit board with the chip-like electric component having this terminal structure mounted thereon is placed in an atmosphere rich in a sulfur component for a long time of period, a problem with electromigration arises.

More specifically, when the terminal structure of the chip-like electric component is exposed to the atmosphere containing sulfur (S) and moisture, the sulfur (S) enters into the component through an interface 15 where the insulating resin layer 9*b* and the conductive thin film layer 13 of the chip-like electric component meet each other with the moisture that has been condensed on the surface of the chip-like electric component working as a medium. In the conventional terminal structure of a chip-like electric component, the insulating resin layer 9*b* is overlapped with the conductive thin film layer 13 at the interface 15. However, the insulating resin layer 9*b* and the conductive thin film layer 13 are not physically or chemically combined. For this reason, it is considered difficult to completely block entry of electromigration-causing factors (e.g. moisture and sulfur). The electromigration-causing factors that have entered cause a sulfuration reaction with Ag in the front electrode 3, thereby producing silver sulfide ($AG_2S$, or a tip-growth type whisker). More specifically, the sulfuration reaction proceeds as follows:

$$Ag \rightarrow Ag^{+} + e^{-}$$

$$S + 2e^{-} \rightarrow S^{2-}$$

$$2Ag + S^{2-} \rightarrow AG_2S$$

In order for this reaction to proceed, ionization of silver is necessary. Thus, the moisture becomes necessary. Once the sulfuration reaction has begun and the silver sulfide has been generated, the silver (Ag) contained in the front electrode 3 is then supplied to the tip of the whisker where Ag concentration is low. It means that silver (Ag) contained in the front electrode 3 comes out from the meeting surface between the insulating resin layer 9*b* and the conductive thin film layer 13. As a result, silver (Ag) contained in the front electrode 3 is reduced due to the sulfuration reaction. Accordingly, a resistance value of the front electrode 3 is increased, which finally causes a problem that the resistance value of the surface electrode 3 reaches to an open level at which disconnection occurs. Japanese Patent Application Publication No. 2002-237402 does not refer to countermeasures for preventing entry of the electromigration-causing factors into the front electrode 3 through the interface 15 between the insulating resin layer 9*b* and the conductive thin film layer 13.

Then, a technique is proposed for preventing entry of the electromigration-causing factors into the front electrode 3 through the interface 15 between the insulating resin layer 9*b* and the conductive thin film layer 13. The surface of the metal-glaze-based surface electrode 3 containing silver is partially covered with an end portion of the insulating resin layer 9*b* that covers the surface of the resistor layer 7. Then, other portions of the surface of the front electrode 3 that are not covered with the end portion are covered with the conductive thin film layer 13. In this condition, a resin-based conductive layer that does not contain silver (conductive layer formed of a paste in which conductive powder other than silver is mixed into a resin) is provided at a boundary between the surface of the front electrode 3 and the surface of the insulating resin layer 9*b* under the conductive thin film layer. The resin-based conductive layer that does not contain silver is intended to prevent entry of the electromigration-causing factors.

Japanese Patent Application Publication No. 2002-184602 (Patent Document 2), for example, discloses that a resin-based conductive layer that does not contain silver but contains nickel as conductive powder is used for this purpose. Further, Japanese Patent Application Publication No. 2004-259864 (Patent Document 3) discloses that a conductive resin paste that uses carbon as conductive powder is used to form a resin-based conductive layer that does not contain silver. Providing the resin-based conductive layer between the front electrode and the conductive thin film may suppress occurrence of electromigration and furthermore, may maintain electrical connection between the conductive thin film and the front electrode.

Each of Japanese Patent Application Publication No. 08-236302 (Patent Document 4) and Japanese Patent Application Publication No. 2002-25802 (Patent Document 5) shows that a resin-based conductive layer containing silver is provided on a front electrode. The Patent Document 4 shows that the resin-based conductive layer containing silver is formed on the front electrode in order to prevent a large level difference from being formed on the front electrode of a chip resistor (in order to planarize the surface of the chip resistor as much as possible). In a chip resistor disclosed in Japanese Patent Application Publication No. 2002-25802 (Patent Document 5), a resin-based conductive layer containing Ag which is highly heat-resisting is formed on the front electrode formed of an Au-based material, in order to protect the front electrode from heat of soldering. Either of these patent documents does not refer to the anti-electromigration performance of the resin-based conductive layers containing Ag. However, WIPO International Publication No. WO2003/046934 (Patent Document 6) cites Japanese Patent Application Publication No. 08-236302 (Patent Document 4) as a conventional art and describes that corrosion is caused due to migration (electromigration) even when the resin-based conductive layer containing silver is provided on the front electrode as shown in Patent Document 4. For this reason, Patent Document 6 teaches that a glass overcoat is formed over a glass cover coat so that the glass overcoat covers a boundary portion between the resin-based conductive layer containing silver and the glass cover coat formed over a resistor body. Covering the boundary portion with the overcoat is intended to prevent occurrence of the electromigration.

Japanese Patent Application Publication No. 2002-64003 (Patent Document 7) shows that a silver-based thick film (a conductive layer containing silver) is provided between a front electrode and a protective layer that covers a resistor body. The silver-based thick film contains 5% or more of palladium, and a rest of the film is formed of silver and a resin. Patent Document 7 shows that the silver-based thick film containing 5% or more of palladium has an excellent anti-electromigration property. In the structure disclosed in Patent Document 7, however, an interface between the protective layer that covers the resistor body and a plated layer, and a short interface between the protective layer and the silver-based thick film, formed continuously with the interface between the protective layer and the plated layer, extend to the front electrode which is not covered with the silver-based thick film. Patent Document 7, in particular, describes that when the silver-based thick film containing 5% or more of palladium is formed on a part of the front electrode (an upper surface electrode), cost may be reduced more, compared with when the front electrode is entirely formed of a silver-based thick film containing palladium and having an excellent anti-electromigration property. Judging from this description, it is presumed that by reducing an amount of the silver-based thick film containing 5% or more of palladium as much as possible, the interface between the protective layer and the silver-based thick film described above will be considerably short in length.

Japanese Patent Application Publication No. 07-169601 (Patent Document 8) shows that a second upper surface electrode layer is provided to extend over an overcoat glass layer on a resistor layer. Since the second upper electrode layer is fired at 600° C., the second upper electrode layer is a metal glaze paste containing silver rather than a resin paste containing silver.

Japanese Patent Application Publication No. 07-302510 (Patent Document 9) discloses a glass-based conductive paste material used for forming a metal-glaze-based electrode rather than a resin electrode. As a conductive constituent of a conductive paste composition, nickel is contained in addition to silver. The conductive paste material contains three types of conductive powder including fine spherical silver powder, coarse spherical silver powder or coarse spherical silver-coated nickel powder, and flake-like silver powder.

Japanese Patent Application Publication No. 2001-126901 (Patent Document 10) shows a configuration of a chip resistor: wherein an upper surface electrode layer is provided on an end portion of an insulating substrate; a resistor layer is provided on the insulating substrate, overlaying the end portion of the upper surface electrode layer; and a protective layer formed of a glass layer alone is provided, covering an entire surface of the resistor layer and partially covering the upper surface electrode layer; a side electrode layer formed of a silver-based thick film or a resin-silver-based thick film is provided, covering the end portion of the protective layer formed of the glass layer alone and an exposed portion of the upper surface electrode layer; and a plated layer is provided, covering a surface of the side electrode layer and the protective layer formed of the glass layer alone. In this chip resistor, the overlap length between the insulating layer and the conductive layer that blocks entry of the electromigration-causing factors is specifically defined.

[Patent Document 1] Japanese Patent Application Publication No. 2002-237402, FIG. 2

[Patent Document 2] Japanese Patent Application Publication No. 2002-184602, FIG. 1

[Patent Document 3] Japanese Patent Application Publication No. 2004-259864, FIG. 1

[Patent Document 4] Japanese Patent Application Publication No. 08-236302, FIG. 1

[Patent Document 5] Japanese Patent Application Publication No. 2002-25802, FIG. 1

[Patent Document 6] WIPO International Publication No. WO2003/046934, FIG. 2

[Patent Document 7] Japanese Patent Application Publication No. 2002-64003, FIG. 1

[Patent Document 8] Japanese Patent Application Publication No. 07-169601, FIG. 1

[Patent Document 9] Japanese Patent Application Publication No. 07-302510

[Patent Document 10] Japanese Patent Application Publication No. 2001-126901, FIG. 1

DISCLOSURE OF THE INVENTION

Problem to be Solved by the Invention

When the conductive layer is formed of the nicked-based or carbon-based conductive resin paste that does not contain silver, as in the structures shown in Patent Documents 2 and 3, there is a problem that costs of the conductive resin paste may become considerably higher than a commonly used silver-based resin paste.

Patent Document 6 describes that electromigration occurs in the conventional structures as described in Patent Documents 4 and 5. When the resin-based overcoat is further added as in the structure described in Patent Document 6, there is a problem that not only the number of manufacturing steps increases, but also the cost accordingly increases due to additional provision of the overcoat. When an overcoat made of a resin was formed on a trimming cover coat made of glass in the structure shown in FIG. 1 of Patent Document 4 or 6, instead of the overcoat made of glass, and then an experiment was carried out, it was confirmed that the electromigration-causing factors entered the resin overcoat located at the peak of a raised portion of a resistor layer, and that an electromigration route was formed from the location of the overcoat to a front electrode along an interface between the resin overcoat and the raised portion of the resistor layer, thereby bringing about no effect of preventing occurrence of the electromigration.

Further, just by partially providing, between the front electrode and the protective layer that covers the resistor body, the silver-based thick film which contains 5% or more of palladium and a rest of which is composed of silver and the resin, as in the structure described in Patent Document 7, electromigration cannot definitely be blocked.

In the structure described in Japanese Patent Application Publication No. 07-169601 (Patent Document 8), even if the second upper surface electrode layer is formed of the metal glaze paste containing silver, a crack occurs in the second upper surface electrode layer containing glass, and electromigration cannot be prevented. Further, a protective layer is formed of a glass layer alone, and a crack thereby occurs. Accordingly, the electromigration-causing factors readily enter into the front electrode.

In the structure disclosed in Japanese Patent Application Publication No. 2001-126901 (Patent Document 10), a protective layer is formed of a glass layer or a resin layer alone. When the protective layer is formed of the glass layer alone, if a crack occurs in the glass layer, the electromigration-causing factors enter into the upper surface electrode layer. When the protective layer is formed of the resin layer alone, trimming is not possible. When the structure is actually implemented in which an end portion surface of the protective layer is covered with a side electrode formed of a resin-silver-based thick film, an adequate film thickness cannot be obtained. Thus, entry of the electromigration-causing factors into the upper surface electrode layer cannot be prevented.

Accordingly, an object of the present invention is to provide a terminal structure of a chip-like electric component capable of preventing entry of electromigration-causing factors through an insulating resin layer in the vicinity of the top of a raised portion of an electrical element forming layer.

Another object of the present invention is to provide a terminal structure of a chip-like electric component capable of blocking entry of the electromigration-causing factors into a front electrode through an interface between the insulating resin layer and a conductive thin film layer, by defining an appropriate length for an interface for a conductive layer formed with a resin that blocks entry of the electromigration-causing factors.

A further object of the present invention is to provide a terminal structure of a chip-like electric component in which the conductive layer, which is formed of the resin that blocks entry of the electromigration-causing factors and is arranged along an inclined end portion surface of the insulating resin layer, works highly effectively.

A still other object of the present invention is to provide a terminal structure of a chip-like electric component capable of blocking entry of the electromigration-causing factors through the insulating resin layer in the vicinity of the top of the raised portion of the electrical element forming layer and also capable of making adjustment to the electrical element forming layer after the electric component has been mounted onto a circuit board.

Means for Solution to Problem

A configuration of the present invention which achieves the above objects will be described hereinbelow.

In a terminal structure of a chip-like electric component according to the present invention, a metal-glaze-based front electrode containing silver is provided on a surface of an insulating ceramic substrate. An electrical element forming layer is formed on the surface of the substrate, being electrically connected to the front electrode. A glass layer is formed, covering the electrical element forming layer, and an insulating resin layer is provided to cover the glass layer and to partially cover the front electrode. The glass layer and the insulating resin layer jointly form an electrically-insulating protective layer. At lease one conductive thin film layer is formed above a portion of the front electrode that is not covered with the insulating resin layer, and forms an interface with a surface of the insulating resin layer. A conductive layer, which is made of a resin-based conductive paint, is provided to extend over the surface of the front electrode and to extend in the vicinity of a peak of a raised end portion of the insulating resin layer. The at least one conductive thin film layer is disposed above the front electrode through the conductive layer.

A pair of front electrodes may be provided on the surface of the insulating ceramic substrate. Alternatively, plural pairs of front electrodes may be provided. Further, side electrodes may be formed, extending over the front electrodes and side surface of the substrate that is continuous with the front surface of the insulating ceramic substrate. Further, a back electrode connected to the side electrode may be formed on a back surface of the insulating ceramic substrate.

In the terminal structure of the chip-like electric component of the present invention, the glass layer is provided to completely cover the surface of the electrical element forming layer as well as the surface of the end portion of the electrical element forming layer and also to partially cover the front electrode. The insulating resin layer is provided to completely cover a surface of the glass layer as well as a surface of an end portion of the glass layer and also to partially cover the front electrode. An overlap length between the insulating resin layer and the conductive layer is defined so as to block electromigration whereby silver contained in the front electrode migrates along an interface between the insulating resin layer and the conductive layer, and separates out from a boundary portion between the conductive thin film layer and the insulating resin layer. The overlap length is measured in a direction where the front electrode and the electrical element forming layer are arranged.

When the glass layer is provided to completely cover the surface of the electrical element forming layer as well as the surface of the end portion of the electrical element forming layer and also to partially cover the front electrode, and the insulating resin layer is provided to completely cover the surface of the glass layer as well as the surface of the end portion of the glass layer, and also to partially cover the front electrode as described above, the surface of the end portion of the electrical element forming layer is entirely covered with the glass layer. Then, the entire surface of the glass layer, which covers the surface of the end portion of the electrical element forming layer, is covered with the insulating resin layer. Accordingly, even if electromigration-causing factors have entered into the insulating resin layer in the vicinity of the peak of a raised portion of the electrical element forming layer, the glass layer is present under the insulating resin layer. Entry of the electromigration-causing factors may be thereby blocked. Consequently, according to the present invention, entry of the electromigration-causing factors into front electrode through the insulating resin layer in the vicinity of the peak of the raised portion of the electrical element forming layer may be sufficiently blocked. Further, the overlap length between the insulating resin layer and the conductive layer, as measured in the arrangement direction of the front electrode and the electrical element forming layer is defined to block electromigration whereby silver contained in the front electrode migrates along the interface between the insulating resin layer and the conductive layer, and separates out from the boundary portion between the conductive thin film layer and the insulating resin layer. With this arrangement, it may be possible to sufficiently block migration of the silver contained in the front electrode along the interface between the insulating resin layer and the conductive layer and then separating-out of the silver after coming out from the boundary portion between the conductive thin film layer and the insulating resin layer due to the electromigration.

The present invention may be applied to a terminal structure of a trimmable chip-like electric component as well. In this terminal structure, in order to allow laser trimming to be performed on an electrical element forming layer after the chip-like electric component has been mounted onto a circuit board, a glass layer is not entirely covered with an insulating resin layer. The insulating resin layer is provided to cover the surface of an end portion of the glass layer and to partially cover the surface of a front electrode. Even in the terminal structure of the trimmable chip-like electric component as described above, an overlap length between the insulating resin layer and a conductive layer, as measured in an arrangement direction of the front electrodes and the electrical element forming layer, is defined so that silver contained in the front electrode is prevented from migrating along an interface between the insulating resin layer and the conductive layer and then being separated out from a boundary portion between a conductive thin film layer and the insulating resin layer.

In the present invention in particular, the resin-based conductive paint is obtained by kneading particulate conductive silver powder and scale-like conductive silver powder into an epoxy-based insulating resin paint. Those skilled in the art commonly understood that even if a resin-based conductive layer containing silver is formed on the front electrode, electromigration cannot be prevented, as described in Patent Document 6 mentioned above. For this reason, in the invention described in Patent Document 6, a third layer of overcoat made of a resin is further formed. However, the inventors of the present invention made various studies to find some solution to prevent electromigration just by providing a resin-based conductive layer containing silver, contrary to the common sense of those skilled in the art. To be more specific, the inventors have discovered that, by forming the conductive layer using the resin-based conductive paint made by kneading the particulate conductive silver powder and the scale-like conductive silver powder into the epoxy-based insulating resin paint after formation of the protective layer of the two-layer structure described above, and by increasing the overlap length between the insulating resin layer and the conductive layer, it may be possible to positively block migration of silver contained in the front electrode along the interface between the insulating resin layer and the conductive layer and then separating-out of the silver after coming out from the boundary portion between the conductive thin film layer and the insulating resin layer due to electromigration. It is not clear why use of the resin-based conductive paint made by kneading the particulate conductive silver powder and the scale-like conductive silver powder into the epoxy-based insulating resin paint is preferable. The inventors infer that it may be because, in the conductive layer formed with this conductive paint, an amount of silver powder that is present along a side of the inclined resin layer is reduced, and a junction strength at the interface is thereby increased. Then, an overlap length is defined to be sufficient for compensating for reduction in electromigration blocking performance due to occurrence of variations in the junction strength caused by an inconstant presence condition of the silver powder in the vicinity of the interface.

Especially, just by providing the glass layer so that the glass layer covers the surface of the electrical element forming layer as well as the surface of the end portion of the electrical element forming layer and also partially covers the front electrode, by providing the insulating resin layer so that the insulating resin layer covers the surface of the glass layer as well as the surface of at least the end portion of the glass layer and also partially covers the front electrode, and by forming the conductive layer with the resin-based conductive paint containing silver, occurrence of electromigration may be blocked. The chip-like electric component such as a chip resistor may be therefore manufactured with the smaller number of manufacturing steps, and the chip-like electric component may be provided at low price.

Preferably, the content of the particulate conductive silver powder is larger than the content of the scale-like conductive silver powder. In other words, the content of the scale-like conductive silver powder is smaller than the content of the particulate conductive silver powder. With such compounding, the amount of the silver powder in the conductive layer located in the vicinity of the interface between the conductive layer and the insulating resin layer may positively be reduced. Specifically, when a ratio of the particulate conductive silver powder to the scale-like conductive silver powder is defined to range from 6:4 to 9:1, the amount of the silver powder in the conductive layer located in the vicinity of the interface between the conductive layer and the insulating resin layer may positively be reduced after securing conductivity in a thickness direction of the conductive layer. When a ratio of the scale-like powder is smaller than the lower limit value in this range, the conductivity is worsened. When the ratio of the scale-like powder is larger than the upper limit value in this range, the amount of the silver powder in the conductive layer located in the vicinity of the interface becomes too much.

Preferably, a particle size of the particulate conductive silver powder falls within a range of 0.5 to 1.2 μm, and a longer side size of the scale-like conductive silver powder falls within a range of 8 to 18 μm.

Preferably, the conductive paint made by kneading the particulate conductive silver powder having a particle size of 0.8 to 1 μm and the scale-like conductive silver powder having a longer side size of 10 to 15 μm into xylene-phenol resin having a viscosity of 40 to 80 Pa·s is used.

When the compounding ratio as described above is employed and the viscosity of the resin to be used is within the range of 40 to 80 Pa·s, it may be possible to control over a thickness and an area of the conductive layer when forming the layer. For this reason, when the conductive paint as described above is used, the thickness and the application area of the conductive layer may be properly controlled with reproducibility.

When the overlap length between the insulating resin layer and the conductive layer, as measured in the direction where the front electrode and the electrical element forming layer are arranged, is defined to be 20 μm or more, necessary and sufficient junction strength for the interface between the insulating resin layer and the conductive layer may positively be ensured. Entry of the electromigration-causing factors into the front electrode through the interface between the insulating resin layer and the conductive thin film layer may be thereby prevented positively. The upper limit of the overlap length is restricted by a thickness of the insulating resin layer. Under the present situation, the upper limit of the thickness obtained by one printing is of the order of 20 μm.

The conductive thin film layer formed of one or more layers may be constituted by a plated layer having a multi-layered structure of two or more layers.

The terminal structure of a chip-like electric component of the present invention may be of course applied to a terminal structure of a chip-like electric component of the simplest type in which a pair of surface electrodes are provided on a surface of an insulating ceramic substrate. In addition, the terminal structure of the present invention may be applied to a terminal structure of a chip-like electric component of a type having a side electrode formed extending over the front electrode and the side surface continuous with the front surface of an insulating ceramic substrate. Further, the terminal structure of the present invention may be applied to a terminal structure of a chip-like electric component of a type having a front electrode, back electrode, and side electrode, as well.

BEST MODE FOR CARRYING OUT THE INVENTION

Figure 1:
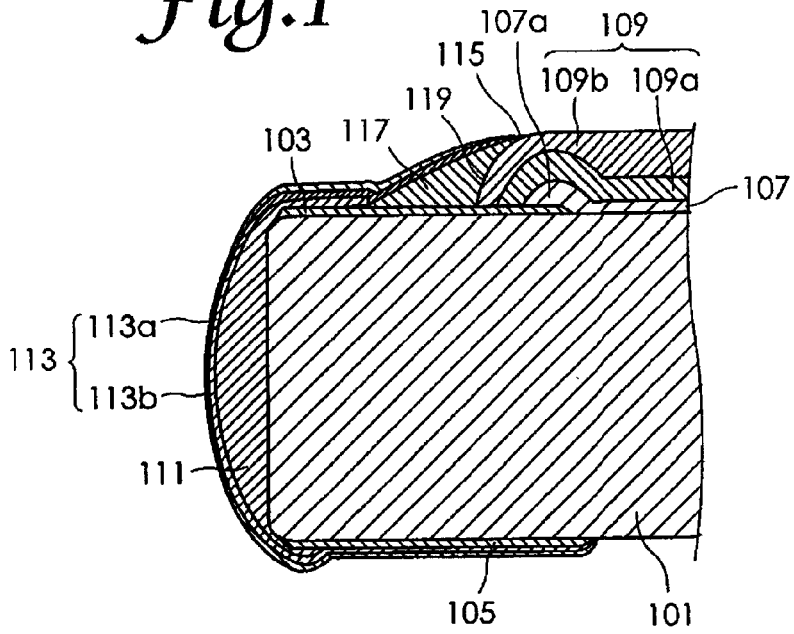
FIG. 1 is a vertical sectional view showing an example of a terminal structure of a chip-like electric component in an embodiment of the present invention.
Figure 3:
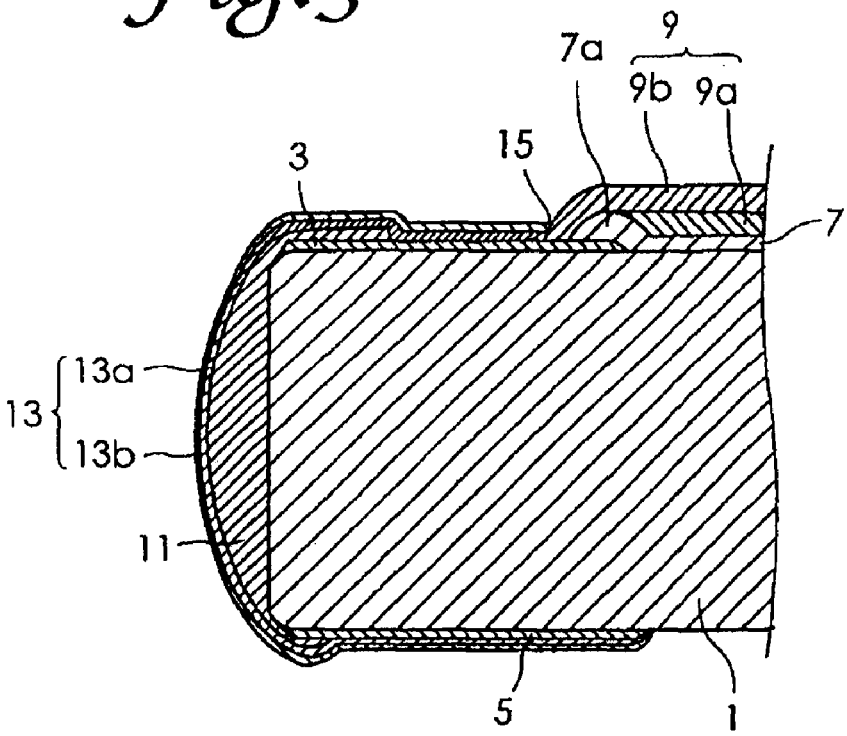
FIG. 3 is a vertical sectional view showing a conventional terminal structure of a chip-like electric component.

An example of a terminal structure of a chip-like electric component according to the present invention will be described in detail with reference to a vertically sectional view shown in FIG. 1 wherein the terminal structure according to the present invention is applied to a terminal structure of a chip-like resistor. Reference numerals obtained by adding 100 to reference numerals used in FIG. 3 are assigned to components corresponding to those in FIG. 3 described before, for illustration.

In the terminal structure of the chip-like resistor in this embodiment, a metal-glaze-based surface electrode 103 and a metal-glaze-based back electrode 105 both containing silver are respectively provided on a front surface and a back surface of an insulating ceramic substrate 101. These metal-glaze-based front electrode 103 and metal-glaze-based back electrode 105 both containing silver are respectively formed by forming an electrode pattern on the insulating ceramic substrate by means of screen printing using a metal glaze paste and then firing the electrode pattern. The metal glaze paste is formed by kneading Ag or an Ag—Pd conductive powder, for example, into a glass paste. An end portion of a resistor layer 107 formed on a surface of the substrate 101 is connected to the front electrode 103, and the end portion is raised so that the end portion of the resistor layer 107 overlaps with the front electrode 103. The resistor layer 107 is also formed by forming a resistor material on the surface of the insulating ceramic substrate 101 by means of screen printing and then baking the resistor material. A surface of the resistor layer 107 is covered with an electrically-insulating protective layer 109 of a two-layer structure. The electrically-insulating protective layer 109 is formed of the two-layer structure of a glass layer 109*a* and a resin layer (an insulating resin layer) 109*b*, and a portion of the front electrode 103 is also covered with the electrically-insulating protective layer 109. In other words, the surface of the resistor layer 107 as well as the surface of an end portion thereof is completely covered with the glass layer 109*a*, and the portion of the front electrode 103 adjacent to the end portion of the resistor layer 107 is also covered with the glass layer 109*a*. A surface of the glass layer 109*a* as well as a surface of an end portion completely covered with the resin layer 109*b*, and the portion of the front electrode 103 adjacent to the end portion of the glass layer 10*a* on an end portion side of the resistor layer 107 is also covered with the resin layer 109*b*. The glass layer 109*a* is provided for a purpose of laser trimming as well. The resin layer 109*b* is provided for a purpose of filling a trimming groove formed by the laser trimming and for a purpose of protecting the glass layer 109*a*. According to the purpose, an electrically-insulating protective layer of a three-layer structure or a four-layer structure may be employed as the electrically-insulating protective layer 109. In this embodiment, the resin layer 109*b* is formed of an epoxy-based resin by means of screen printing.

A conductive layer 117 is formed by using a resin-based conductive paint so that the conductive layer 117 extends over both of a surface of the resin layer 109*b* of the electrically-insulating protective layer 109 and a surface of the front electrode 103. As the resin-based conductive paint, a paint is used in which particulate conductive silver powder and scale-like conductive silver powder are kneaded into the paint of an epoxy insulating resin such as xylene-phenol resin or epoxy-phenol resin. The conductive paint, in which the particulate conductive silver powder having a particle size of 0.5 to 1.2 μm and the scale-like conductive silver powder having a longer side of 8 to 18 μm are kneaded, is used as a preferred conductive paint. Preferably, a compounding or blending ratio of the particulate conductive silver powder having a particle size of 0.5 to 1.2 μm to the scale-like conductive silver powder having a longer side of 8 to 18 μm is defined to range from 6:4 to 9:1, for example. When the compounding ratio as described above is defined, it may be possible to control over an application thickness and an application area of the conductive layer 117 as long as a viscosity of the resin to be used is within a range of 40 to 80 Pa·s. For this reason, when such a conductive paint is used, the thickness and the application area of the conductive layer 117 may be controlled with reproducibility. A particularly preferable particle size of the particulate conductive silver powder is approximately 0.8 to 1 μm, and a particularly preferable longer side of the scale-like conductive silver powder is approximately 10 to 15 μm. According to an experiment, the most preferable compounding ratio of the particulate powder to the scale-like powder among blending ratios is 90 to 10 by weight and 90 to 10 by volume. The respective measured sizes indicate the particle diameters frequently observed in SEM observation. The particle size of the particulate powder is controlled by determining reacting conditions, and selecting or adjusting a reagent to be used. The particle size of the scale-like powder is controlled mainly by determining pulverization conditions. It is not clear why use of the resin-based conductive paint in which the particulate conductive silver powder and the scale-like conductive silver powder are kneaded into the epoxy-based insulating resin paint is preferable. The inventors of the present invention infer that, it may be because, in the conductive layer 117 formed with this conductive paint, an amount of silver powder that is present along a side of the inclined resin layer 109*b* is reduced, and a junction strength at an interface 119 is thereby increased. Then, an overlap length is defined to be sufficient for compensating for reduction in electromigration blocking performance caused by occurrence of variations in the junction strength. The variations in the junction strength occur because a presence condition of the silver powder in the vicinity of the interface 119 is not constant.

When the resin containing silver is used as the conductive paint, the conductive layer 117 is formed by printing the conductive paint, baking at approximately 200° C. for 30 minutes, and then firing.

In this embodiment, a side electrode 111 that electrically connects the front electrode 103 and the back electrode 105 is provided at an end portion of the insulating ceramic substrate 101. The side electrode 111 is connected to the front electrode 103 and the conductive layer 117 on the front surface, and is connected to the back electrode 105 on the back surface. The side electrode 111 is formed to extend over the front electrode 103, conductive layer 117, and back electrode 105. The side electrode 111 is formed using an Ag-resin-based conductive paint in which silver is mixed into xylene-phenol resin or epoxy-phenol resin.

A conductive thin film layer 113 of a two-layer structure is formed to cover an entire surface of the side electrode 111, a surface of the conductive layer 117, an exposed end portion surface of the resin layer 109*b*, and an entire back surface of the back electrode 105. The conductive thin film layer 113 of the two-layer structure is formed of a plated layer of a multi-layered structure having two or more layers. The conductive thin film layer 113 in this embodiment is formed of a lower conductive thin film layer 113*a* and an external conductive thin film layer 113*b*. The lower conductive thin film layer 113*a* is formed of a nickel-plated layer, while the external conductive thin film layer 113*b* is formed of a solder-plated layer.

In this embodiment, an overlap length between the resin layer 109*b* and the conductive layer 117, as measured in a direction where the front electrode 103 and the resistor layer 107 are arranged, is defined so that electromigration may be blocked or prevented. In other words, the overlap length is defined to suppress silver contained in the front electrode 103 from migrating along the interface 119 between the resin layer 109*b* and the conductive layer 117, and separating or coming out from an interface 115 between the conductive thin film layer 113 and the resin layer 109*b* due to electromigration. Specifically, in this embodiment, it is considered that the overlap length between the resin layer 109*b* and the conductive layer 117, as measured in the direction where the front electrode 103 and the resistor layer 107 are arranged, should be at least 20 μm. Since the glass layer 109*a* and the resin layer 109*b* are overlaid on the peak of a raised portion 107*a* of the resistor layer 107 and the conductive layer 117 is overlaid on an inclined surface of the resin layer 109*b* inclined from the top of the resin layer 109*b*, the overlap length between the resin layer 109*b* and the conductive layer 117 may be readily obtained by controlling the thickness of each layer. The upper limit of the overlap length is naturally limited by a length of the front electrode 103. When the overlap length between the resin layer 109*b* and the conductive layer 117, as measured in the direction where the surface electrode 103 and the resistor layer 107 as the electrical element forming layer are arranged, is defined to be 20 μm or more, a necessary and sufficient junction strength for the interface 119 between the resin layer 109*b* and the conductive layer 117 may positively be ensured. Entry of electromigration-causing factors into the front electrode 103 through the interface 115 between the resin layer 109*b* and the conductive thin film layer 113 may be thereby prevented positively. When the overlap length between the resin layer 109*b* and the conductive layer 117 is defined to be 20 μm, the number of years during which electromigration may be blocked or prevented is approximately 40 years, according to estimation of an acceleration test result based on the Arrhenius law. Then, when the overlap length is defined to be 150 μm, the number of years during which electromigration may be blocked or prevented is approximately 100 years. An average thickness of the conductive layer 117 formed in the manner as described above is usually falls into a range of 10 to 30 μm. A preferable thickness of the conductive layer 117 necessary for obtaining the overlap length of at least 20 μm is 10 to 30 μm.

Next, electromigration test results obtained from acceleration testing are shown in Table 1. In the test, electric current is supplied to a conventional chip-like resistor (resistor of a comparative example) shown in FIG. 3 and the chip-like resistor in this embodiment (resistor of the present invention) against which an anti-electromigration measure has been taken, as shown in FIG. 1, in an atmosphere of $H_2S$ of 3 ppm at a temperature of 50° C. and an environmental humidity of 95%.

TABLE 1

| Test Time (hours) | 1000 | 2000 | 3000 | 4000 | 4500 | 5000 | 5500 | 6000 |
|---|---|---|---|---|---|---|---|---|
| Comparative Examples (Conventional Products) | ○ | ○ | ○ | ○ | $x_1$ | $x_2$ | $x_1$ | $x_1$ |
| Embodiments (Present Invention) | ○ | ○ | ○ | ○ | ○ | ○ | ○ | ○ |

TABLE 1-continued

| Test Time (hours) | 6500 | 7000 | 8000 | 8500 | 9000 | 10000 | 10500 |
|---|---|---|---|---|---|---|---|
| Comparative Examples (Conventional Products) | $x_3$ | $x_1$ | $x_1$ | — | — | — | — |
| Embodiments (Present Invention) | ○ | ○ | ○ | ○ | ○ | ○ | ○ |

Notes:
A circle symbol (○) denotes "No disconnection occurred due to electromigration."
A cross symbol (x) denotes "Disconnection occurred due to electromigration."
A bar symbol (—) denotes "Testing already finished."
A subscript number to "x" denotes the number of disconnections.
The number of samples is ten (10) for each testing.

As a result of the test, electromigration occurred in the conventional resistor after 4500 hours, and front electrodes 3 were all disconnected due to the electromigration in 8000 hours. In contrast therewith, the life of the resistor of the present invention was increased at least about two times or longer than that of the conventional resistor.

As described above, in the terminal structure of the chip-like resistor in this embodiment, the glass layer 109*a* is provided so that the glass layer 109*a* completely covers the surface of the resistor layer 107 as well as the surface of the end portion and partially covers the front electrode 103. Then, the resin layer 109*b* is provided so that the resin layer 109*b* completely covers the surface of the glass layer 109*a* as well as the surface of the end portion and partially covers the front electrode 103. Thus, even if the electromigration-causing factors have entered into the resin layer 109*b* in the vicinity of the peak or top of the raised portion of the resistor layer 107, the glass layer 109*a* is present under the location of the resin layer 109*b*, so that entry of the electromigration-causing factors may be blocked. Further, the conductive layer 117 made of the resin-based conductive paint is formed to extend over the surface of the resin layer 109*b* and the surface of the front electrode 103, and the conductive thin film layer 113 of one or more layers is provided above the front electrode 103 through the conductive layer 117. Thus, a length of the interface 119 with the surface of the resin layer 109*b* is increased due to the conductive layer 117 made of the resin-based conductive paint. Accordingly, entry of the electromigration-causing factors into the front electrode 103 through the interface 115 between the resin layer 109*b* and the conductive thin film layer 113 may be blocked. For this reason, even if the terminal structure of the chip-like resistor is arranged in a location where the electromigration-causing factors are present, silver contained in the metal glaze front electrode 103 is hardly sulfurated by the electromigration-causing factors. Then, disconnection of the front electrode 103 is may be avoided.

In the embodiment described above, the present invention is applied to the terminal structure of the chip-like electric component of a type wherein the front electrode 103 and the back electrode 105 are provided respectively on either sides of the end portion of the insulating ceramic substrate 101; the front electrode 103 is connected to the resistor layer 107; the electrically-insulating protective layer 109 is provided to cover the surface of the resistor layer 107 and to partially cover the front electrode 103; and the side electrode 111 is provided at each end portion of the insulating ceramic substrate 101, electrically connecting the front electrode 103 and the back electrode 105. The present invention is not limited to this configuration. The present invention may also be applied to a terminal structure of the chip-like electric component of a type wherein the back electrode 105 is not provided; and the side electrode 111 and the conductive thin film layer 113 are provided to cover the side surface of the insulating ceramic substrate 101. Or the present invention may be applied to a terminal structure of the chip-like electric component of a type wherein only the front electrode is provided without providing the back electrode 105 and the side electrode 111. In the latter terminal structure, the conductive layer 117 is provided to cover an exposed portion of the front electrode 103, and the conductive thin film layer 113 is provided to cover an end portion of the resin layer 109*b*, a surface of the conductive layer 117, and an end surface of the front electrode 103.

Figure 2:
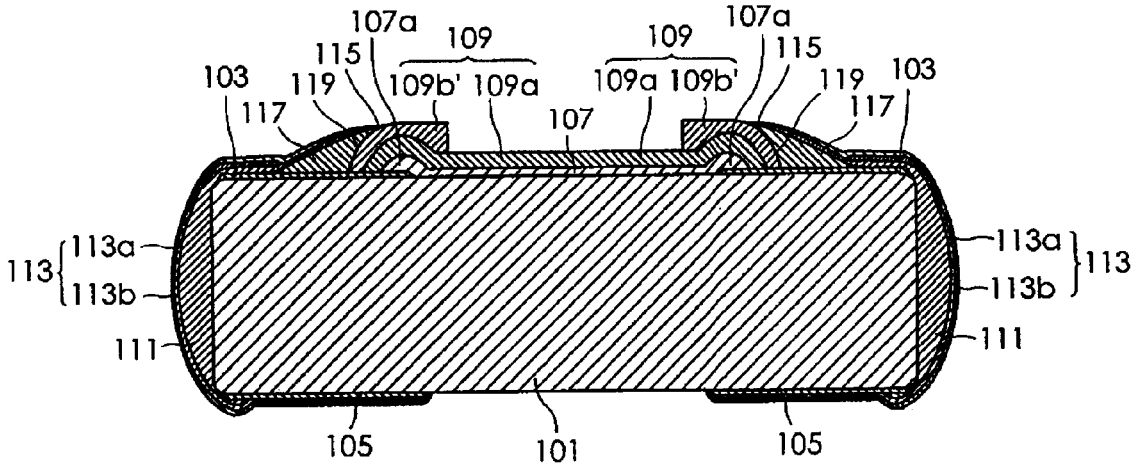
FIG. 2 is a vertical sectional view showing another example of a terminal structure of a chip-like electric component in an embodiment of the present invention.

FIG. 2 shows a schematic sectional view of another embodiment, in which the present invention is applied to a terminal structure of a chip-like variable resistor wherein a resistor layer is trimmable. Referring to FIG. 2, the same reference numerals are assigned to components that are the same as those in the embodiment shown in FIG. 1, and a description about the same components will be omitted. In the embodiment shown in FIG. 2, a resin layer 109*b*' that forms an insulating resin layer is provided to cover a surface of an end portion of the glass layer 109*a* and to partially cover the front electrode 103. For this reason, a central portion of the glass layer 109*a* is exposed. When a trimming groove is formed in the glass layer 109*a* and the resistor layer 107 by irradiating laser onto the exposed portion of the glass layer 109*a*, trimming adjustment may also be performed after the resistor has been mounted onto a circuit board. When the electromigration-causing factors enter from the resin layer 109*b* in the vicinity of the peak of the raised portion of the resistor layer 107 in this embodiment as well, entry of the electromigration-causing factors may be blocked because the glass layer 109*a* is present under the resin layer 109*b*'.

In each of the embodiments described above, the present invention was applied to the terminal structure of the chip-like resistor. The present invention is not limited to these embodiments, and the present invention may also be applied to a terminal structure of other chip-like electronic components such as a chip-like inductor, a chip-like capacitor and a terminal structure of a chip-like electric component of a multiple structure.

INDUSTRIAL APPLICABILITY

According to the present invention, the glass layer is provided to completely cover the surface of the electrical element forming layer as well as the surface of the end portion and to partially cover the front electrode. The insulating resin layer is provided to cover the surface of the glass layer as well as the surface of at least the end portion and to partially cover the front electrode. Then, the overlap length between the insulating resin layer and the conductive layer, as measured in the arrangement direction of the front electrode and the electrical element forming layer, is defined to suppress the silver contained in the front electrode from migrating along the interface between the insulating resin layer and the conductive layer, separating our or coming out from a boundary portion between the conductive thin film layer and the insulating resin layer due to electromigration. Occurrence of the electromigration may be thereby blocked with more positively than in the conventional art. The chip-like electric component such as a chip resistor may be therefore manufactured with the smaller number of manufacturing steps, and the chip-like electric component may be provided at low price.

The invention claimed is:

1. A terminal structure of a chip-like electric component that includes:

a metal-glaze-based front electrode containing silver, said front electrode being provided on a surface of an insulating ceramic substrate;

an electrical element forming layer electrically connected to the front electrode and formed on the surface of the substrate;

an electrically-insulating protective layer including a glass layer that covers the electrical element forming layer, and an insulating resin layer that covers the glass layer and partially covers the front electrode;

the glass layer completely covering a surface of the electrical element forming layer as well as a surface of an end portion of the electrical element forming layer, and also partially covering the front electrode;

the insulating resin layer completely covering a surface of the glass layer as well as a surface of an end portion of the glass layer, and also partially covering the front electrode, the insulating resin layer having a raised end portion;

a conductive layer formed of a resin-based conductive paint, and provided to extend in the vicinity of a peak of the end raised portion of the insulating resin layer and also to extend over the surface of the front electrode; and at least one conductive thin film layer that forms an interface with a surface of the insulating resin layer, and is formed, via the conductive layer, above a portion of the front electrode that is not covered with the insulating resin layer, wherein the resin-based conductive paint is made by kneading particulate conductive silver powder and scale-like conductive silver powder into a xylene-phenol-based resin selected from epoxy-based resins and having a viscosity of 40 to 80 Pa·s;

the particulate conductive silver powder has a particle size of 0.8 to 1 μm and the scale-like conductive silver powder has a longer-side size of 10 to 15 μm;

a compounding ratio of the particulate conductive silver powder to the scale-like conductive silver powder ranges from 6:4 to 9:1; and the length of the overlapped portion between the insulating resin layer and the conductive layer, as measured in the direction where the front electrode and the electrical element forming layer are arranged, is 20 μm or more.

2. A terminal structure of a chip-like electric component that includes:

a pair of metal-glaze-based front electrodes containing silver, said front electrodes being provided on a surface of an insulating ceramic substrate;

an electrical element forming layer electrically connected to the pair of front electrodes and formed on the surface of the substrate;

an electrically-insulating protective layer including a glass layer that covers the electrical element forming layer, and an insulating resin layer that covers the glass layer and partially covers the pair of front electrodes;

the glass layer completely covering a surface of the electrical element forming layer as well as a surface of an end portion of the electrical element forming layer, and also partially covering the pair of front electrodes;

the insulating resin layer completely covering a surface of the glass layer as well as a surface of an end portion of the glass layer, and also covering a part of the respective front electrodes in the pair, the insulating resin layer having raised end portions;

conductive layers each formed of a resin-based conductive paint, and each provided to extend in the vicinity of a peak of an end raised portion of the insulating resin layer and also to extend over the surface of the front electrode adjacent to the end raised portion; and at least one conductive thin film layer that forms an interface with a surface of the insulating resin layer, and is formed, via the conductive layer, above a portion of the front electrode that is not covered with the insulating resin layer, wherein the resin-based conductive paint is made by kneading particulate conductive silver powder and scale-like conductive silver powder into a xylene-phenol-based resin selected from epoxy-based resins and having a viscosity of 40 to 80 Pa·s;

the particulate conductive silver powder has a particle size of 0.8 to 1 μm and the scale-like conductive silver powder has a longer-side size of 10 to 15 μm;

a compounding ratio of the particulate conductive silver powder to the scale-like conductive silver powder ranges from 6:4 to 9:1; and the length of the overlapped portion between the insulating resin layer and the conductive layer, as measured in the direction where the front electrode and the electrical element forming layer are arranged, is 20 μm or more.

3. A terminal structure of a chip-like electric component that includes:

a metal-glaze-based front electrode containing silver, the front electrode being provided on a surface of an insulating ceramic substrate;

a side electrode formed so as to extend over the front electrode and a side surface continuous with the surface of the substrate where the front electrode is disposed;

an electrical element forming layer electrically connected to the front electrode and formed on the surface of the substrate;

an electrically-insulating protective layer including a glass layer that covers the electrical element forming layer, and an insulating resin layer that covers the glass layer and partially covers the front electrode;

the glass layer completely covering a surface of the electrical element forming layer as well as a surface of an end portion of the electrical element forming layer, and also partially covering the front electrode;

the insulating resin layer completely covering a surface of the glass layer as well as a surface of an end portion of the glass layer, and also partially covering the front electrode, the insulating resin layer having a raised end portion;

a conductive layer formed of a resin-based conductive paint, and provided to extend in the vicinity of a peak of the end raised portion of the insulating resin layer and also to extend over the surface of the front electrode; and at least one conductive thin film layer that forms an interface with a surface of the insulating resin layer, and is formed, via the conductive layer, above an exposed portion of the front electrode that is not covered with the insulating resin layer and the side electrode, wherein the resin-based conductive paint is made by kneading particulate conductive silver powder and scale-like conductive silver powder into a xylene-phenol-based resin selected from epoxy-based resins and having a viscosity of 40 to 80 Pa·s;

the particulate conductive silver powder has a particle size of 0.8 to 1 μm and the scale-like conductive silver powder has a longer-side size of 10 to 15 μm;

a compounding ratio of the particulate conductive silver powder to the scale-like conductive silver powder ranges from 6:4 to 9:1; and the length of the overlapped portion between the insulating resin layer and the conductive layer, as measured in the direction where the front electrode and the electrical element forming layer are arranged, is 20 μm or more.

4. A terminal structure of a chip-like electric component that includes:

a metal-glaze-based front electrode containing silver, the front electrode being provided on a surface of an insulating ceramic substrate;

an electrical element forming layer electrically connected to the front electrode and formed on the surface of the substrate;

a glass layer that covers the electrical element forming layer, the glass layer completely covering a surface of the electrical element forming layer as well as a surface of an end portion of the electrical element forming layer, and also partially covering the front electrode;

an insulating resin layer covering the glass layer, the insulating resin layer covering a surface of an end portion of the glass layer, and also partially covering the front electrode, the insulating resin layer having a raised end portion;

a conductive layer formed of a resin-based conductive paint, and provided to extend in the vicinity of a peak of the end raised portion of the insulating resin layer and also to extend over the surface of the front electrode; and at least one conductive thin film layer that forms an interface with a surface of the insulating resin layer, and is formed, via the conductive layer, above a portion of the front electrode that is not covered with the insulating resin layer, wherein the resin-based conductive paint is made by kneading particulate conductive silver powder and scale-like conductive silver powder into a xylene-phenol-based resin selected from epoxy-based resins and having a viscosity of 40 to 80 Pa·s;

the particulate conductive silver powder has a particle size of 0.8 to 1 μm and the scale-like conductive silver powder has a longer-side size of 10 to 15 μm;

a compounding ratio of the particulate conductive silver powder to the scale-like conductive silver powder ranges from 6:4 to 9:1; and the length of the overlapped portion between the insulating resin layer and the conductive layer, as measured in the direction where the front electrode and the electrical element forming layer are arranged, is 20 μm or more.

* * * * *